US008658921B2

(12) United States Patent
Therrien et al.

(10) Patent No.: US 8,658,921 B2
(45) Date of Patent: Feb. 25, 2014

(54) UTILITY METER SERVICE SWITCH

(75) Inventors: Wayne Alfred Therrien, Rochester, NH (US); Curtis Whitmore Crittenden, Dover, NH (US)

(73) Assignee: General Electric Company, Schenectady, NY (US)

( * ) Notice: Subject to any disclaimer, the term of this patent is extended or adjusted under 35 U.S.C. 154(b) by 252 days.

(21) Appl. No.: 13/277,846

(22) Filed: Oct. 20, 2011

(65) Prior Publication Data

US 2013/0098744 A1 Apr. 25, 2013

(51) Int. Cl.

| | |
|---|---|
| ***H01H 3/02*** | (2006.01) |
| ***H01H 3/14*** | (2006.01) |
| ***H01H 35/00*** | (2006.01) |

(52) U.S. Cl.

USPC ..... 200/52 R

(58) Field of Classification Search

USPC ..... 200/52 R, 6 R, 11 B, 6 B, 6 C, 43.16, 200/50.32, 61.53, 431, 439, 440, 443, 447, 200/451, 461, 472, 508, 535, 537, 538, 542, 200/558, 559, 561, 562, 566, 568, 249, 250, 200/283, 297; 340/870.02, 870; 335/8–86, 335/121, 124, 128, 177–179, 185–190

See application file for complete search history.

(56) References Cited

U.S. PATENT DOCUMENTS

| | | | | |
|---|---|---|---|---|
| 4,634,819 | A | 1/1987 | Ikeda | |
| 5,227,750 | A | 7/1993 | Connell et al. | |
| 5,329,080 | A * | 7/1994 | Pierce et al. | 200/5 B |
| 5,952,739 | A * | 9/1999 | Grass et al. | 307/126 |
| 6,046,661 | A | 4/2000 | Reger et al. | |
| 7,833,034 | B2 * | 11/2010 | Connell | 439/251 |
| 2009/0294260 | A1 | 12/2009 | Makinson et al. | |
| 2009/0295371 | A1 | 12/2009 | Pontin et al. | |

* cited by examiner

*Primary Examiner* — Edwin A. Leon
*Assistant Examiner* — Anthony R. Jimenez
(74) *Attorney, Agent, or Firm* — Hoffman Warnick LLC

(57) ABSTRACT

Systems for disconnecting and/or connecting service between a utility network and a utility meter are disclosed. In one embodiment, a switch system includes: an actuator connected to a sliding cam for moving the sliding cam between a first position and a second position, the sliding cam slidingly receiving a terminal blade of the utility meter and including a pair of camming surfaces for disengaging a pair of conductors from the terminal blade in response to being moved from the first position to the second position by the actuator.

19 Claims, 14 Drawing Sheets

UTILITY METER SERVICE SWITCH

BACKGROUND OF THE INVENTION

The subject matter disclosed herein relates to utility meters and, more particularly, to service switches within utility meters.

Some utility companies, for example, certain electrical service companies, employ utility meters to regulate and or record the amount of service (e.g. electricity) being consumed by a given location or consumer (e.g., a residence). During operation these utility meters may convey electricity from a utility network to a residence. Installation and/or maintenance work on the utility meter, worn or damaged sockets, improper installation techniques, damage to the utility meter, etc., may cause undesirable installed stresses or loads to form or be discharged within the utility meter. These stresses may transfer to the electrical contact region within the utility meter which, due in part to the high current rating of some utility meters, may potentially damage components and/or lead to a utility meter failure. Some systems attempt to connect or disconnect service at a utility meter by using a rigidly mounted separation system to separate a set of electrical contacts within the utility meter. These systems are disposed within the utility meter and oriented to intermittently contact the electrical contacts when either disconnecting or connecting the electrical contacts. However, these rigid separation systems rely on precisely located internal components to successfully operate. The rigid mounting and precise demands of these systems may make the system difficult to tune and/or adjust and may fail to adequately accommodate components that are misaligned.

BRIEF DESCRIPTION OF THE INVENTION

Systems for disconnecting and/or connecting service between a utility network and a utility meter are disclosed. In one embodiment, a switch system includes: an actuator connected to a sliding cam for moving the sliding cam between a first position and a second position, the sliding cam slidingly receiving a terminal blade of the utility meter and including a pair of camming surfaces for disengaging a pair of conductors from the terminal blade in response to being moved from the first position to the second position by the actuator.

A first aspect of the disclosure provides a switch system including: an actuator connected to a sliding cam for moving the sliding cam between a first position and a second position, the sliding cam slidingly receiving a terminal blade of the utility meter and including a pair of camming surfaces for disengaging a pair of conductors from the terminal blade in response to being moved from the first position to the second position by the actuator.

A second aspect provides a motion transfer system including: a sliding cam configured to complement a terminal blade of the utility meter; and a set of transfer components physically connected to the sliding cam via a pin, wherein the set of transfer components are configured to pivot about the pin and adjust a position of a set of conductors within the utility meter in response to the sliding cam moving about the terminal blade.

A third aspect provides a meter base assembly including: a metering circuit for metering a utility service; a set of conductors operatively connected to the metering circuit; a set of terminal blades disposed within a substantial proximity of the set of conductors, the set of terminal blades configured to operatively connect to the set of conductors via a set of contacts; and a switch system operatively connected to the set of conductors and configured to manipulate the connection between the set of terminal blades and the set of conductors, the switch system including: an actuator; a distribution bar operatively connected to the actuator; and at least one motion transfer system operatively connected to the distribution bar and configured to manipulate the set of conductors, the at least one motion transfer system including: a sliding cam configured to complement the set of terminal blades; and a set of transfer components physically connected to the sliding cam via a pin, wherein the set of transfer components are configured to pivot about the pin and adjust a position of the set of conductors.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
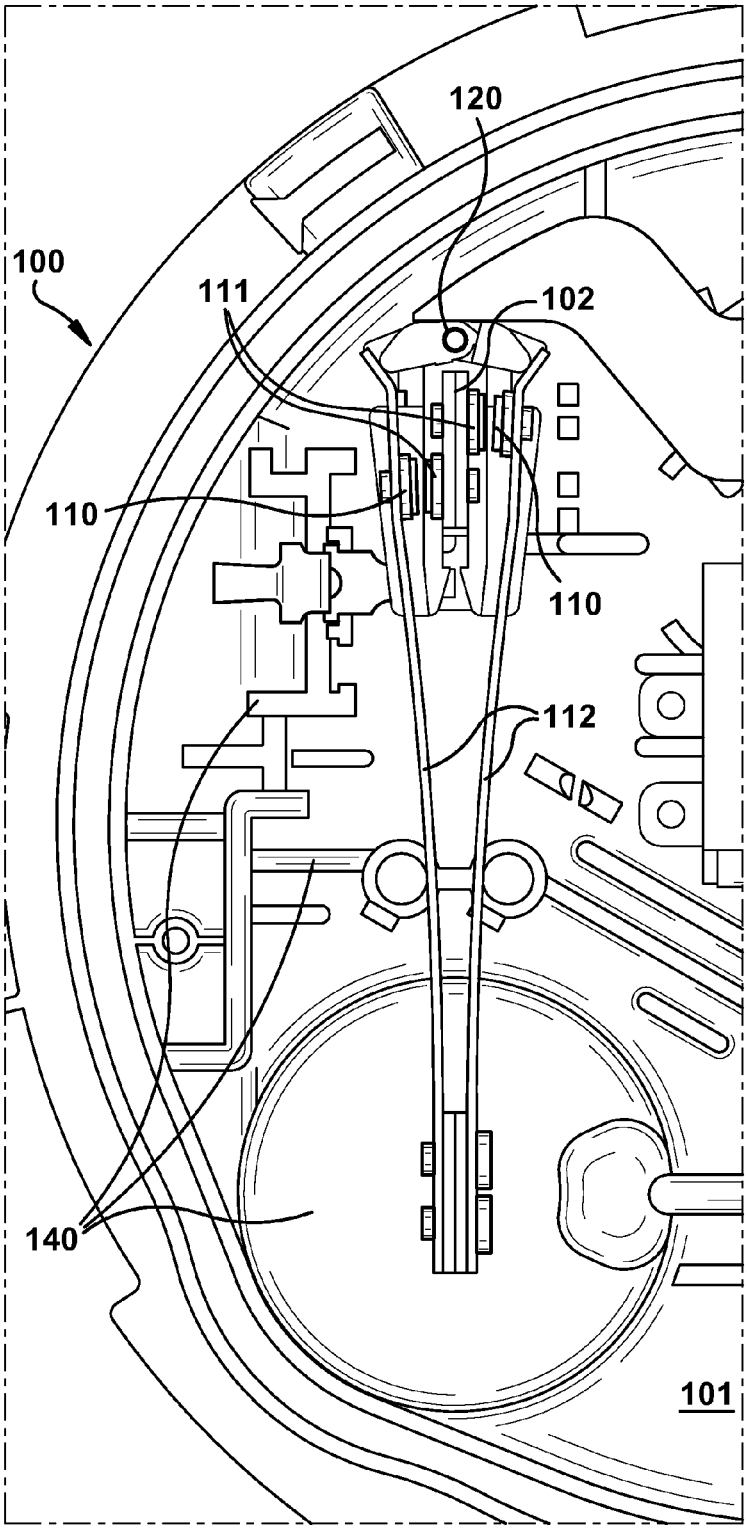
FIG. 1 shows a partial cut-away schematic view of portions of a utility meter according to an embodiment of the invention.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

As indicated herein, aspects of the invention provide for systems configured to connect and disconnect a flow of service at a utility meter (e.g., an electrical meter, a smart meter or any other form of meter configured to monitor utility service consumption at a location). These systems employ at least one motion transfer system operatively connected to an actuator and a set of conductors within the utility meter, the at least one motion transfer system is operable to adjust a position of the set of conductors relative one another, thereby controlling connection and flow of service between a set of contacts on the conductors and a set of contacts on a terminal blade.

Some utility meter systems use a rigidly mounted separation system disposed below the terminal blade and between a set of conductors to drive apart and disconnect a set of conductor contact points. These rigidly mounted separation systems may have mounting and operating requirements which require tight location tolerances between the conductors, the separating system and an actuator mechanism. These requirements may limit motion within the system, making tuning and adjustment of the rigidly mounted separation system difficult. As a result, the ability of the overall system to properly function while in a distressed state may be reduced and the versatility of the system, the design and the overall utility meter may be limited.

In contrast to the conventional system, embodiments of the current invention provide for a utility meter with a switch system which uses and/or incorporates a motion transfer system into the switching process. The motion transfer system includes a sliding cam configured to slidingly receive/connect to a terminal blade of the utility meter. The motion transfer system is operably controlled by an actuator (e.g., solenoid) which manipulates a position of the sliding cam about the terminal blade, moving the motion transfer system between a first position and a second position. As the sliding cam is moved between the positions, the motion transfer system adjusts a position of a set of conductors in the utility meter. These adjustments cause contacts on the conductors to physically connect and disconnect with contacts on the terminal blade, thereby regulating a flow of service through the contacts and the utility meter.

Turning to the FIGURES, embodiments of a utility meter including a switch system are shown, where the switch system may impact the versatility and increase the life expectancy of the utility meter by using a motion transfer system to connect and disconnect the utility meter from a utility network. Each of the components in the FIGURES may be connected via conventional means, e.g., via a wired, wireless, riveted or other known means as is indicated in FIGS. 1-14. Specifically, referring to FIG. 1, a partial cross-sectional view of a utility meter 100 is shown according to embodiments of the invention. Utility meter 100 may include a meter base assembly 101 with a terminal blade 102 configured in substantial proximity to a set of conductors 112. Set of conductors 112 are connected to a metering circuit 140 and are configured to convey a service from terminal blade 102 to metering circuit 140 via a set of conductor contacts 110 and a complementary set of terminal blade contacts 111. Adjustment of a position of set of conductors 112 controls a connection between conductor contacts 110 and terminal blade contacts 111, thereby regulating the state (e.g., connected, disconnected, etc.) of utility meter 100. A motion transfer system 120 slidingly receives/is secured substantially about a portion of terminal blade 102 and between set of conductors 112. Motion transfer system 120 is configured to manipulate set of conductors 112 and thereby adjust a position of set of conductor contacts 110. This adjustment of the position of set of conductor contacts 110, allows conductor contacts 110 to physically touch (e.g., connect) or separate from (e.g., disconnect) terminal blade contacts 111, and thereby regulates the state of utility meter 100.

In an embodiment, terminal blade 102 may be directly connected to a utility network (e.g., line side); terminal blade 102 for conveying the utility service to metering circuit 140 of utility meter 100. In another embodiment, terminal blade 102 may be directly connected to a residence (e.g., load side); terminal blade 102 for conveying the utility service to the residence from utility meter 100. In one embodiment, set of conductors 112 may be copper. In another embodiment, set of conductors 112 may be spring conductors. In another embodiment, set of conductors 112 may be spring tempered conductors. In one embodiment, motion transfer system 120 may be created from nonconductive materials. In one embodiment, motion transfer system 120 may be configured to continually contact set of conductors 112. In another embodiment, motion transfer system 120 may be configured within a substantial proximity of set of conductors 112, motion transfer system 120 controllably contacting set of conductors 112 in response to a prompt. In one embodiment, motion transfer system 120 only contacts set of conductors 112 when manipulating a position of set of conductors 112. In another embodiment, motion transfer system 120 only contacts set of conductors 112 during a given state (e.g., connected, disconnected, etc.) in utility meter 100. In one embodiment, motion transfer system 120 controls and maintains a position of set of conductors 112 relative to terminal blade 102. Motion transfer system 120 maintains a lateral relationship between each of the conductors 112 relative to a lateral location of terminal blade 102 (e.g., set of conductors 112 always move in unison with respect to terminal blade 102 during left to right movements). In one embodiment, motion transfer system 120 is adapted to translate an orthogonal motion from an actuator 250 (shown in FIG. 2) into a longitudinal motion applied to set of conductors 112.

Figure 2:
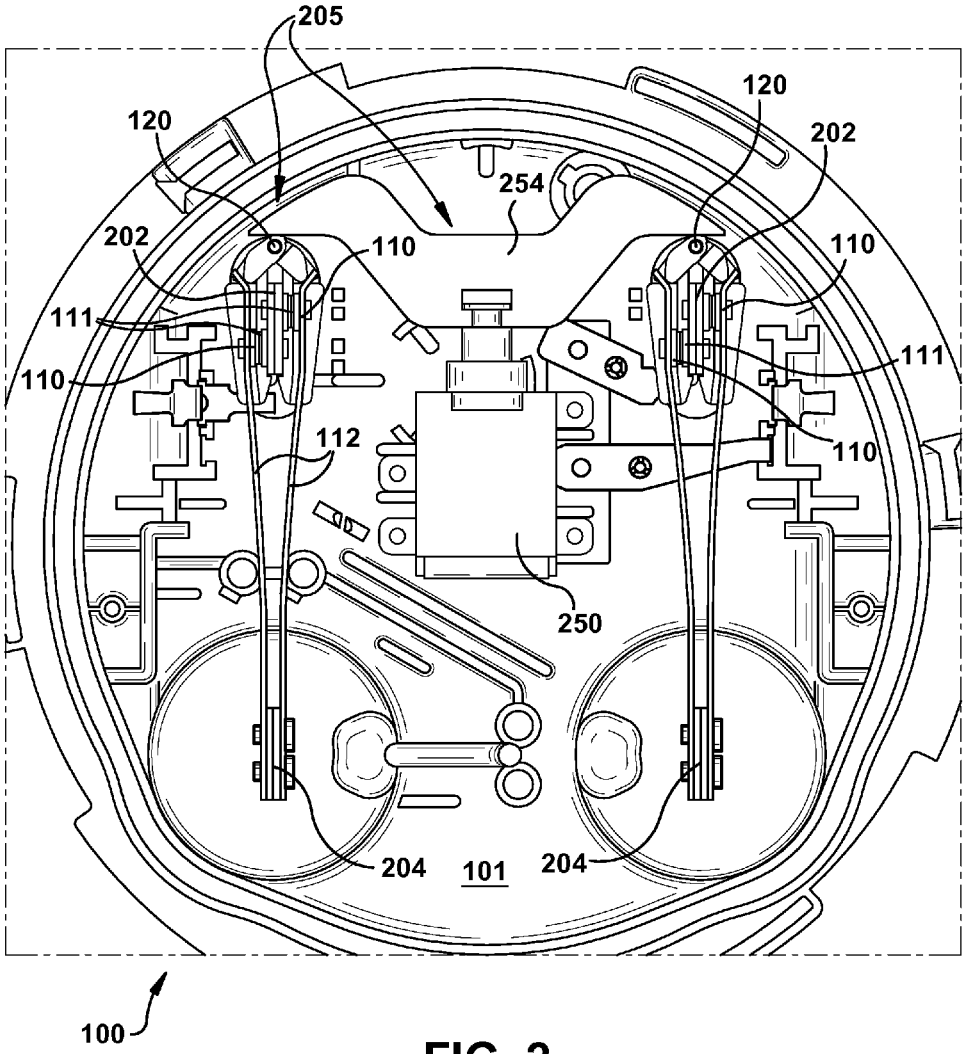
FIG. 2 shows a partial cut-away schematic view of portions of a utility meter according to an embodiment of the invention.
Figure 3:
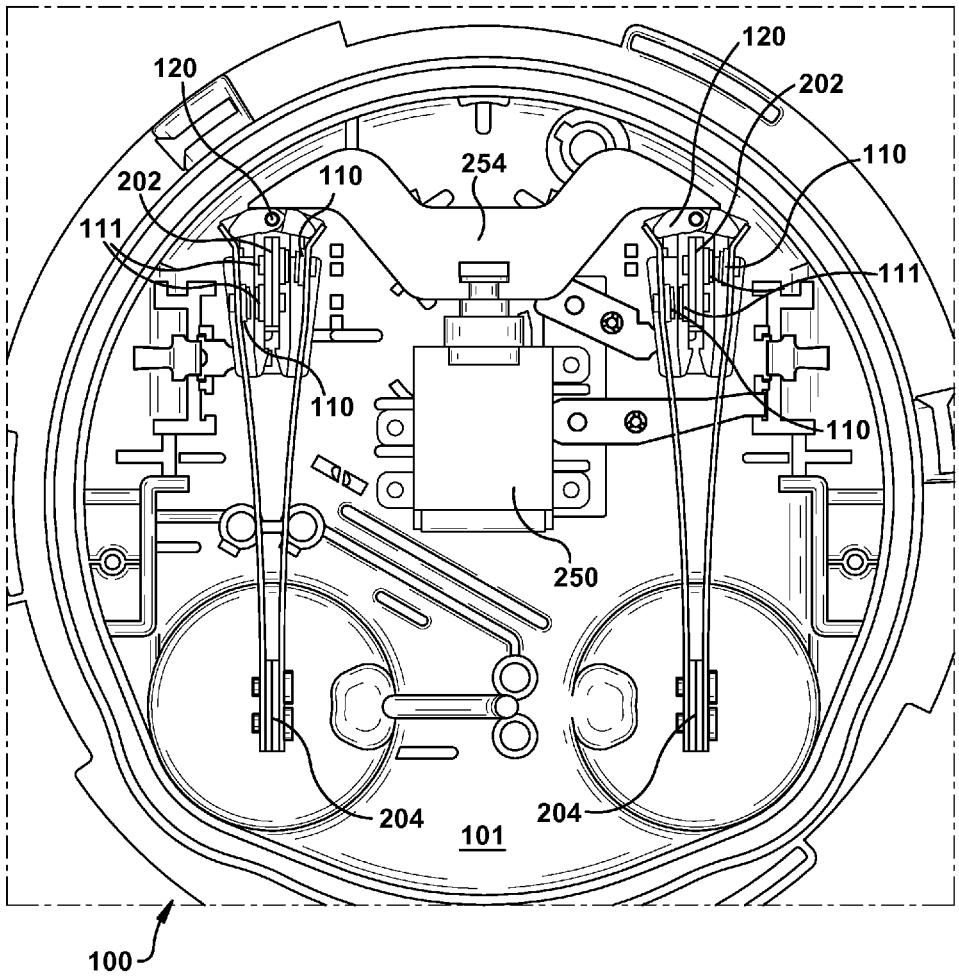
FIG. 3 shows a partial cut-away schematic view of portions of a utility meter according to an embodiment of the invention.

Turning to FIG. 2, a schematic partial cut-away view of a utility meter 100 including a switch system 205 is shown according to embodiments. It is understood that elements similarly numbered between FIG. 1 and FIG. 2 may be substantially similar as described with reference to FIG. 1. Further, in embodiments shown and described with reference to FIGS. 2-14, like numbering may represent like elements. Redundant explanation of these elements has been omitted for clarity. Finally, it is understood that the components of FIGS. 1-14 and their accompanying descriptions may be applied to any embodiment described herein.

Returning to FIG. 2, in this embodiment, utility meter 100 may include a meter base assembly 101 with switch system 205 which includes, an actuator 250 connected to a set of motion transfer systems 120 via a distribution bar 254. Actuator 250 is operable to connect and disconnect utility meter 100 from the utility network by manipulating set of motion transfer systems 120. In this embodiment, actuator 250 adjusts a vertical position of distribution bar 254, this adjustment manipulates a position of set of motion transfer systems 120. Set of motion transfer systems 120 translate the vertical motion into a separating motion. In one embodiment, actuator 250 is a solenoid. In this embodiment, actuator 250 is shown with distribution bar 254 in an upward vertical position with respect to set of conductors 112. This position causes a set of conductor contacts 110 to connect with a set of line side terminal blades 202 and, thereby enable a service/current flow to a set of load side terminal blades 204 via a set of terminal blade contacts 111. In one embodiment, set of conductors 112 are configured to clamp to line side terminal blades 202 in response to a current flowing through set of conductor contacts 110 and set of terminal blade contacts 111. In one embodiment, an electromotive force of the current flowing through set of conductor contacts 110 and set of terminal blade contacts 111 may assist in clamping set of conductors 112 to set of line side terminal blades 202. In another embodiment, shown in FIG. 3, utility meter 100 is in a disconnected state with actuator 250 placing distribution bar 254 in a downward vertical position, thereby compressing set of motion transfer systems 120 and separating set of conductor contacts 110 from set of terminal blade contacts 111. In one embodiment, set of terminal blade contacts 111 and set of line side terminal blades 202 are fixed in a rigid position on meter base assembly 101.

Figure 4:
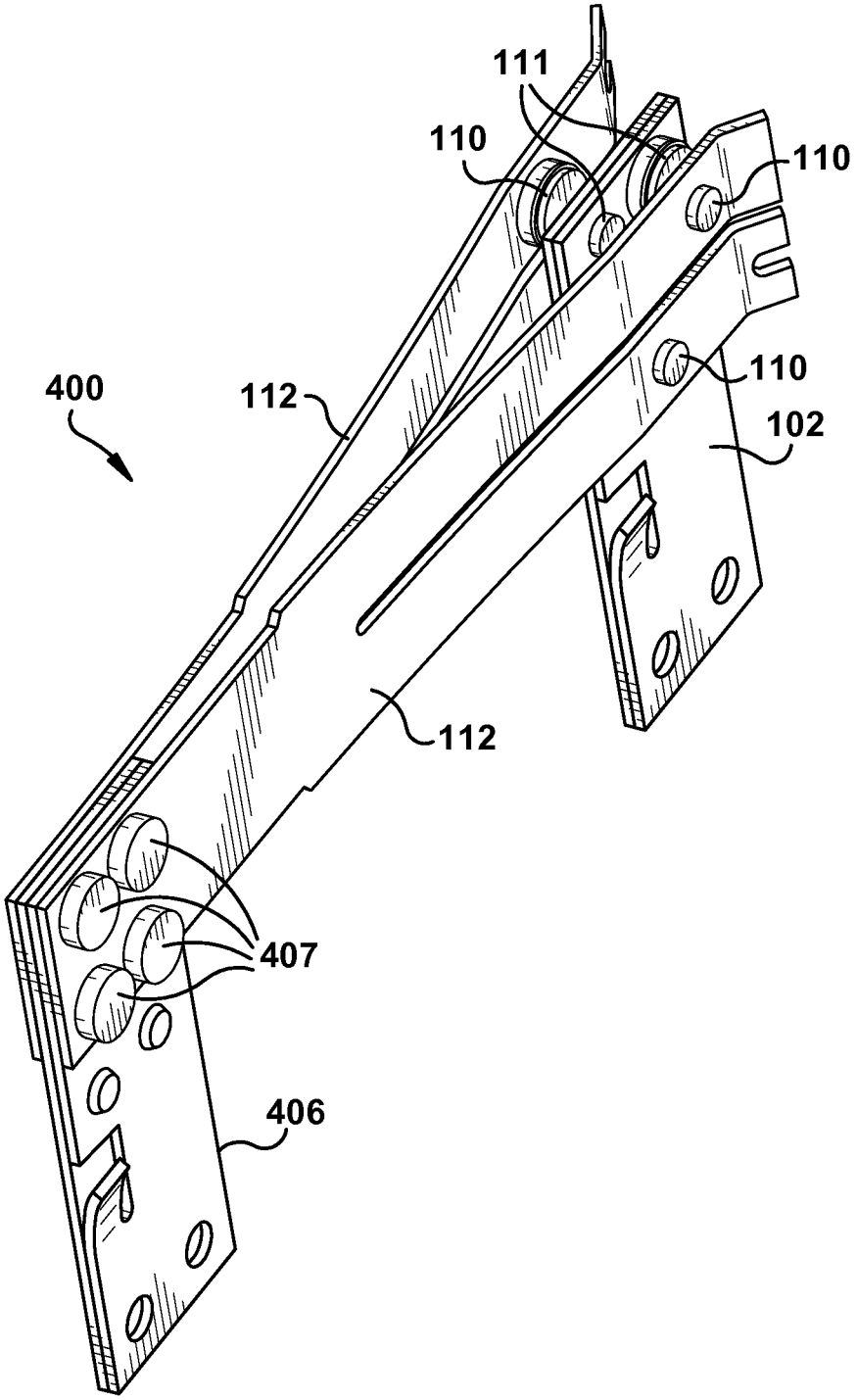
FIG. 4 shows a three-dimensional perspective view of a set of conductors according to an embodiment of the invention.
Figure 5:
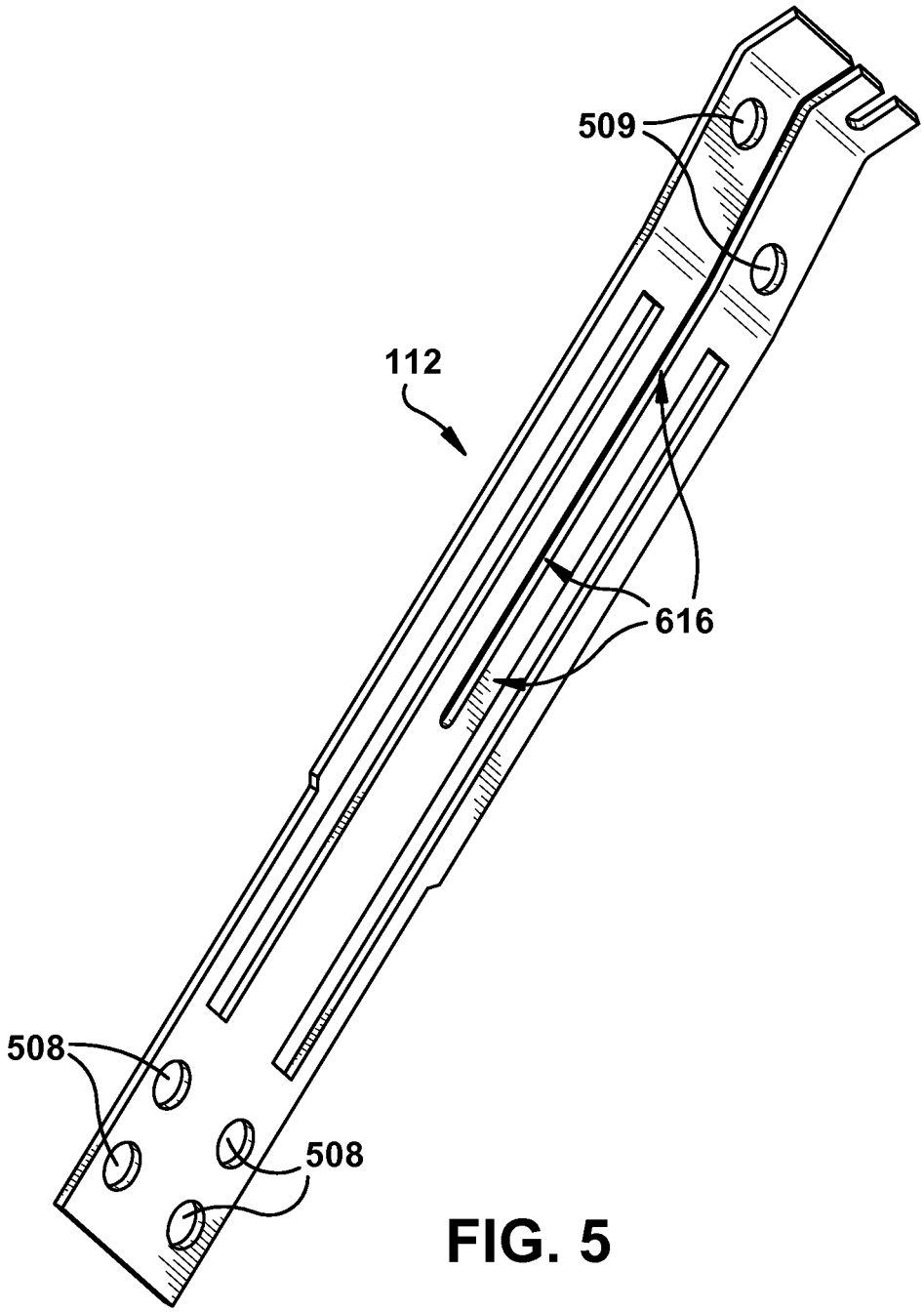
FIG. 5 shows a three-dimensional perspective view of a conductor according to an embodiment of the invention.

Turning to FIG. 4, a perspective view of a set of conductors 112 configured about a terminal blade 102 and connected to a load-side terminal blade 406 is shown according to embodiments. In this embodiment, set of conductors 112 may be connected to load-side terminal blade 406 via a set of rivets 407. In one embodiment, set of conductors 112 may include a plurality of conductor contacts 110 configured to connect with a plurality of terminal blade contacts 111. In another embodiment, shown in FIG. 5, a conductor 112 defines a plurality of apertures 508 at a distal end. Plurality of apertures 508 are configured to complement a plurality of apertures in load-side terminal blade 406 for affixing conductor 112 to load-side terminal blade 406. In one embodiment, conductor 112 further defines a set of apertures 509 at a distal end opposite plurality of apertures 508. Set of apertures 509 are configured to receive and retain set of contacts 110. In another embodiment, conductor 112 may define a notch 616. Notch 616 is configured to complement a guide vane 722 (shown in FIG. 7) of motion transfer system 120. In one embodiment, notch 616 mitigates inter-dependencies of the set of contacts 110 attached at apertures 509, thereby enabling contacts 110 to operate independently in terms of spring pressures and opening and closing positions. In this embodiment, notch 616 assists in vertically orienting motion transfer system 700 (shown in FIG. 7).

Figure 6:
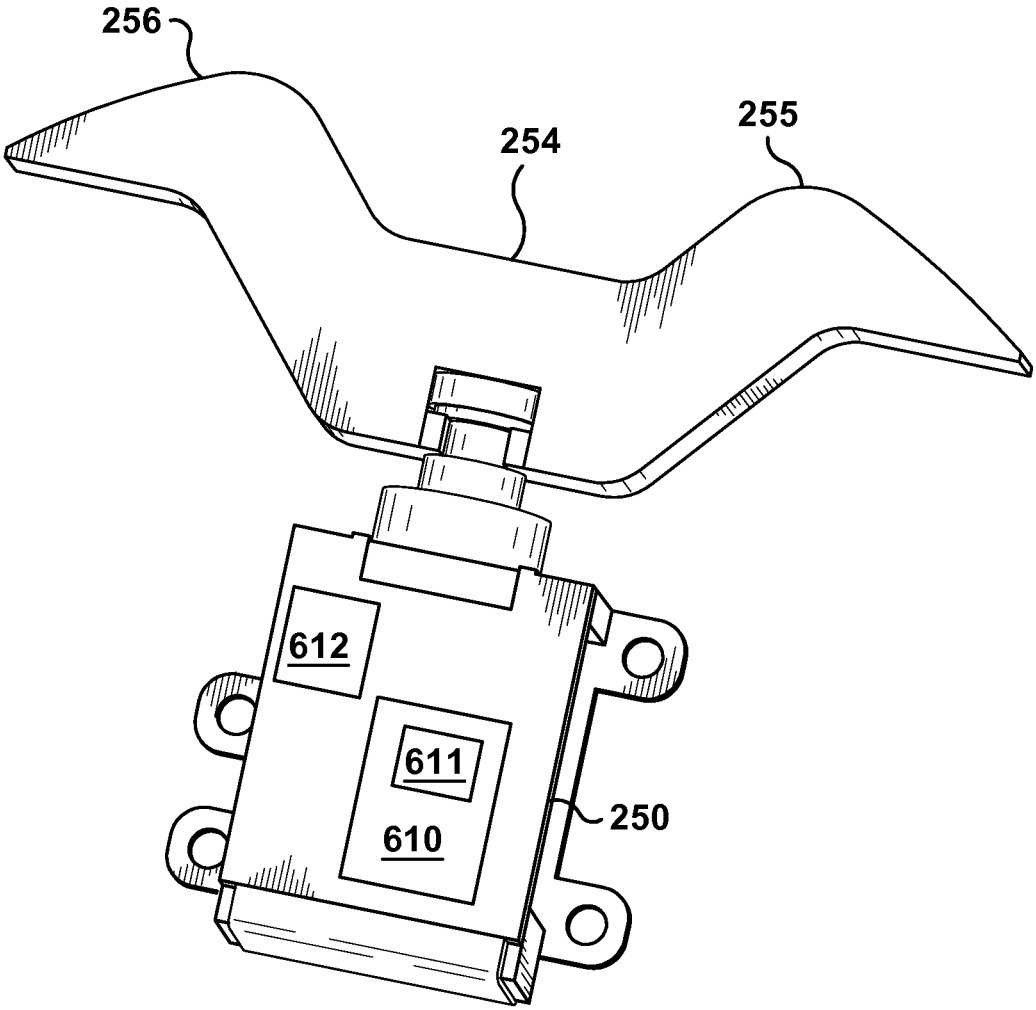
FIG. 6 shows a three-dimensional perspective view of an actuator and a distribution bar according to an embodiment of the invention.

Turning to FIG. 6, a perspective view of an actuator 250 operably connected to a distribution bar 254 is shown according to embodiments of the invention. In this embodiment, vertical motion by actuator 250 is directly conveyed to distribution bar 254. In one embodiment, the vertical motion uniformly adjusts a position of distribution bar 254. Distribution bar 254 is configured to distribute vertical motion from actuator 250 to a set of components within utility meter 100 via a first arm 255 and a second arm 256. This motion distribution by distribution bar 254 manipulates set of motion transfer systems 120 by conveying motion from actuator 250. It is understood that set of motion transfer systems 120 may include a single motion transfer system 120, multiple motion transfer systems 120, or any number of motion transfer systems 120 as may be required or designed into a given device, meter or application. In one embodiment, motion transfer system 120 may be laterally aligned with respect to actuator 250 and distribution bar 254 such that longitudinal positional control of motion transfer system 120 is controlled by actuator 250 and distribution bar 254. In another embodiment, motion transfer system 120 may be laterally misaligned with respect to actuator 250 and distribution bar 254, but longitudinal positional control of motion transfer system 120 is maintained by actuator 250 and distribution bar 254. The independence of motion transfer system 120, distribution bar 254 and actuator 250 relative one another enabling longitudinal positional control to be maintained even when lateral alignment is off.

In one embodiment, actuator 250 includes a service switch 610 with an off position and on position. Service switch 610 is operable to activate and control actuator 250 in response to a user prompt. In one embodiment, service switch 610 may include a receiver 611 to enable a connection with a remote user via power line communication, radio frequency communication, cellular communication or any other known means. In another embodiment, service switch 610 may be communicatively connected to a user interface, the user interface configured to enable control of actuator 250. In one embodiment, distribution bar 254 is comprised of a nonconductive material. In another embodiment, actuator 250 may include a latch 612 for securing a position of actuator 250. Latch 612 may enable actuator 250 to maintain either a connected or a disconnected position of distribution bar 254 without consuming energy.

Figure 7:
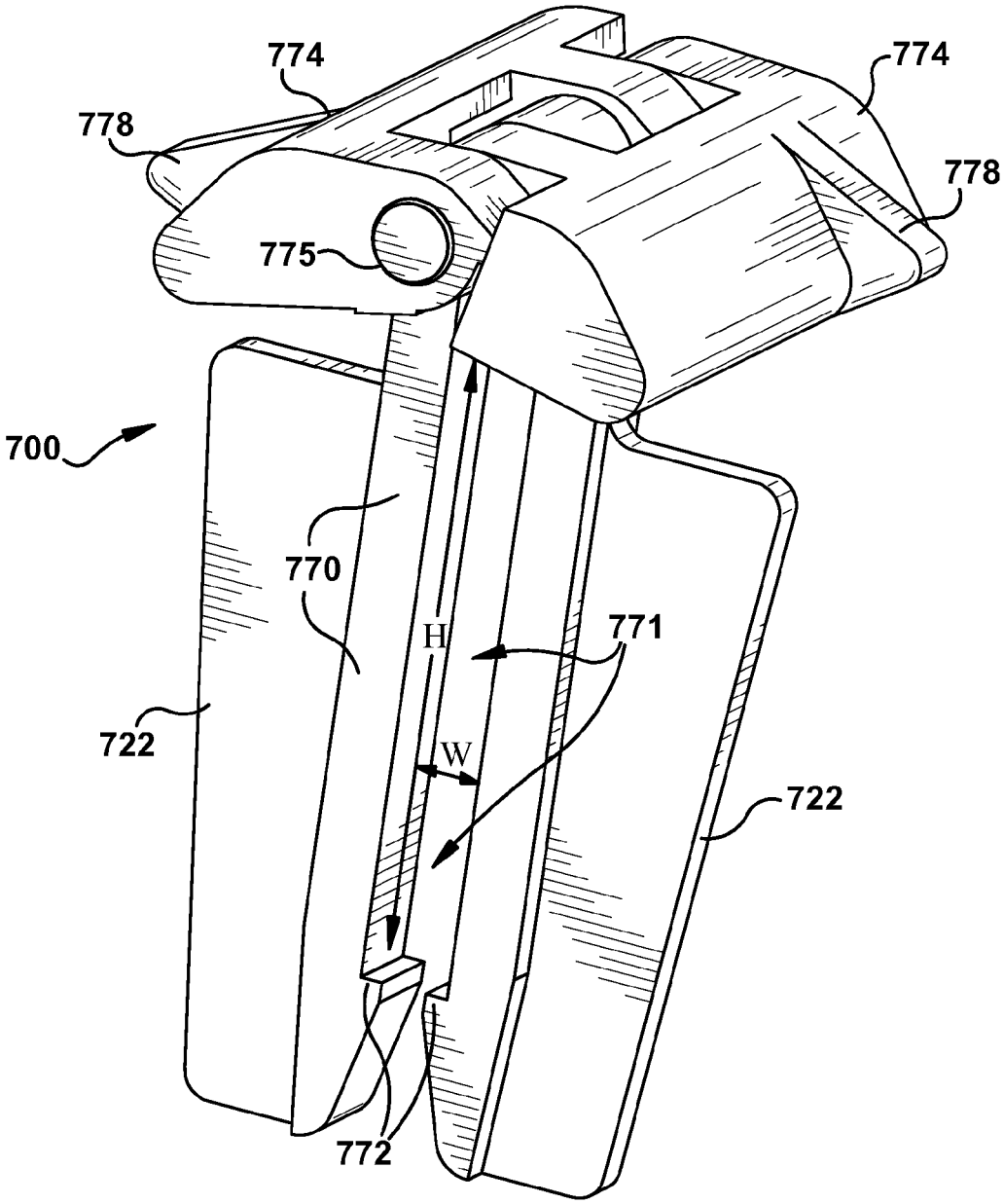
FIG. 7 shows a three-dimensional perspective view of an embodiment of a motion transfer system in accordance with an aspect of the invention.

Turning to FIG. 7, a perspective view of an embodiment of a motion transfer system 700 is shown according to embodiments. In this embodiment, a set of transfer components 774 are connected to a sliding cam 770 via a pin 775. Sliding cam 770 includes a set of guide vanes 722 and defines an aperture 771 which is configured to substantially complement/slidingly receive terminal blade 102. In one embodiment, aperture 771 is a slot. In one embodiment, a width 'W' of aperture 771 may be substantially similar to a dimension of terminal blade 102, and a height 'H' of aperture 771 may be substantially larger than a dimension of terminal blade 102, thereby enabling guided motion of sliding cam 770 about terminal blade 102. In one embodiment, sliding cam 770 is configured to slide substantially bi-directionally about terminal blade 102. In one embodiment, sliding cam 770 is configured to slide vertically about terminal blade 102. In one embodiment, sliding cam 770 may include a pair of notches 772 for securing sliding cam 770 about terminal blade 102. In another embodiment, sliding cam 770 is configured to substantially enclose a portion of terminal blade 102. In one embodiment, transfer components 774 may be hinged to sliding cam 770. In another embodiment, transfer components 774 may be centrally pivoted about pin 775. In one embodiment, pin 775 may be integral to at least one of transfer components 774. In another embodiment, pin 775 may be integral to a single transfer component 774. In another embodiment, pin 775 may be integral to sliding cam 770.

In an embodiment of the invention, transfer components 774 are connected to sliding cam 770 such that a vertical motion of sliding cam 770 about terminal blade 102 causes transfer components 774 to pivot about pin 775 and generate a separating motion. In one embodiment, transfer components 774 may include a set of flanges 778 oriented to restrict longitudinal travel of transfer components 774 and initiate spreading action of motion transfer system 700. In one embodiment, transfer components 774 may be configured substantially proximate set of conductors 112 (shown in FIG. 1) such that adjustment of a position of sliding cam 770 causes transfer components 774 to contact and/or manipulate a position of set of conductors 112. In one embodiment, at least one of sliding cam 770, set of transfer components 774 or pin 775 may be nonconductive.

Figure 8:
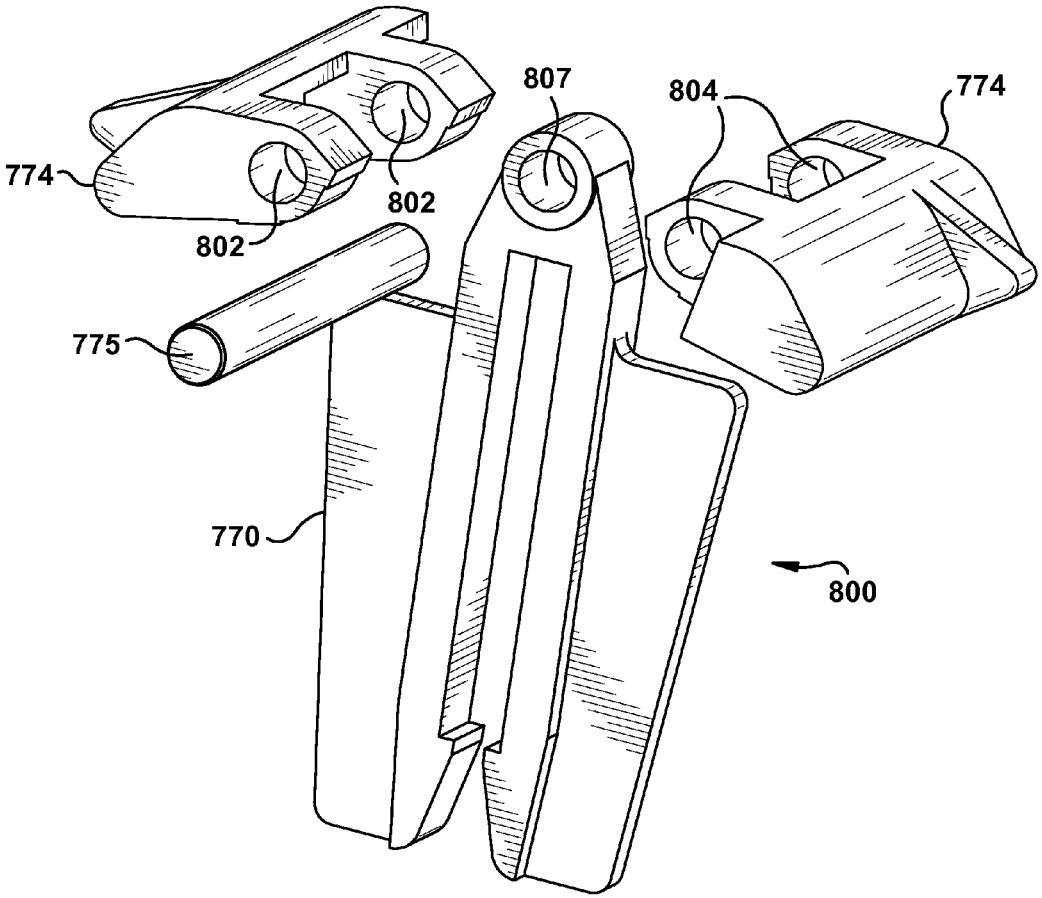
FIG. 8 shows a three-dimensional perspective view of an embodiment of a motion transfer system in accordance with an aspect of the invention.

Turning to FIG. 8, an exploded perspective view of a motion transfer system 800 is shown according to embodiments. In this embodiment, transfer components 774 include a set of apertures 804 configured to receive pin 775. In one embodiment, sliding cam 770 includes an aperture 807 configured to receive pin 775. Pin 775 is insertable through apertures 804 and 807 to connect transfer components 774 and sliding cam 770. In one embodiment, pin 775 may be affixed to any of transfer components 774 or sliding cam 770. In another embodiment, pin 775 may be freely rotatable within apertures 804 and 807.

Figure 9:
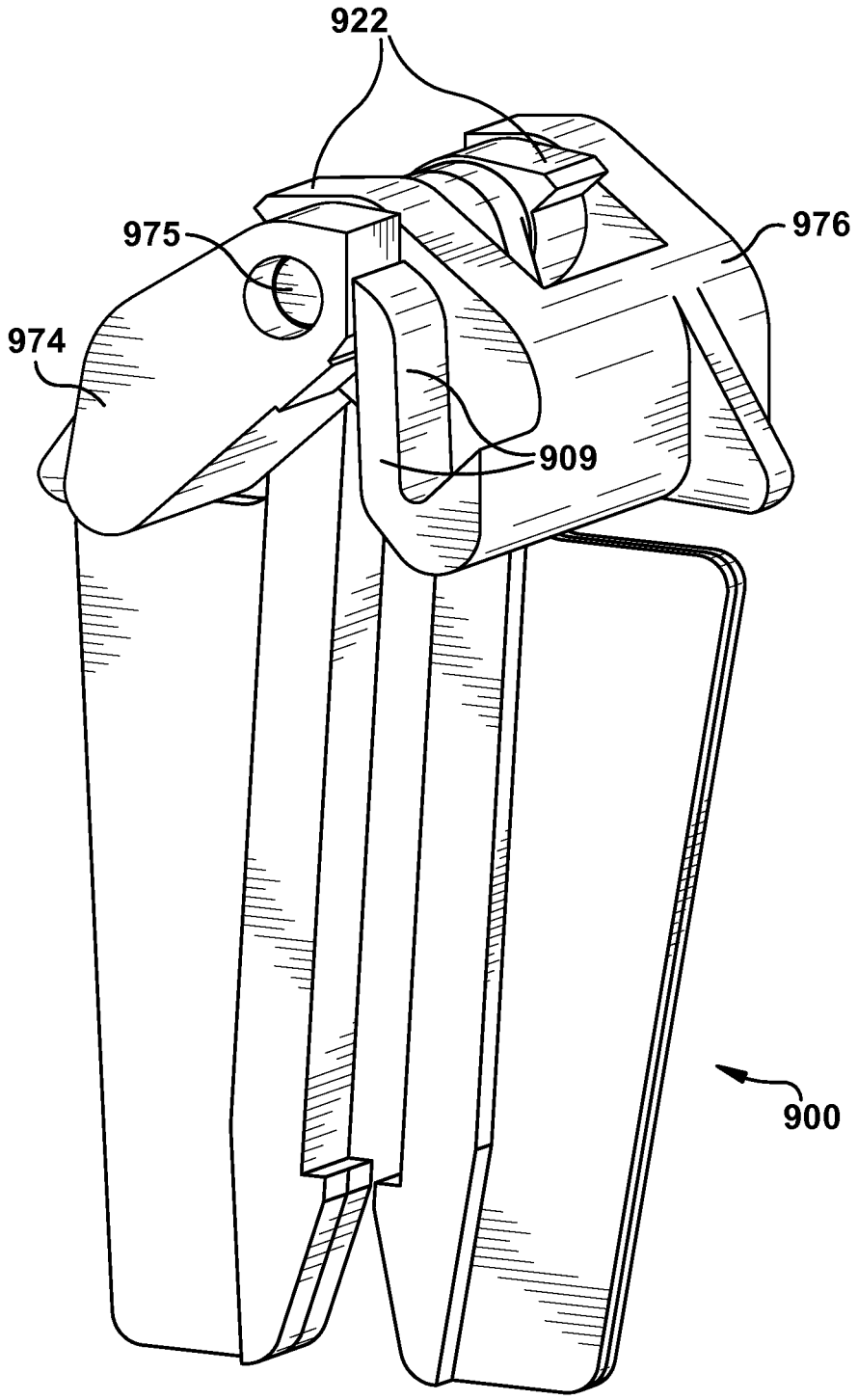
FIG. 9 shows a three-dimensional perspective view of an embodiment of a motion transfer system in accordance with an aspect of the invention.
Figure 10:
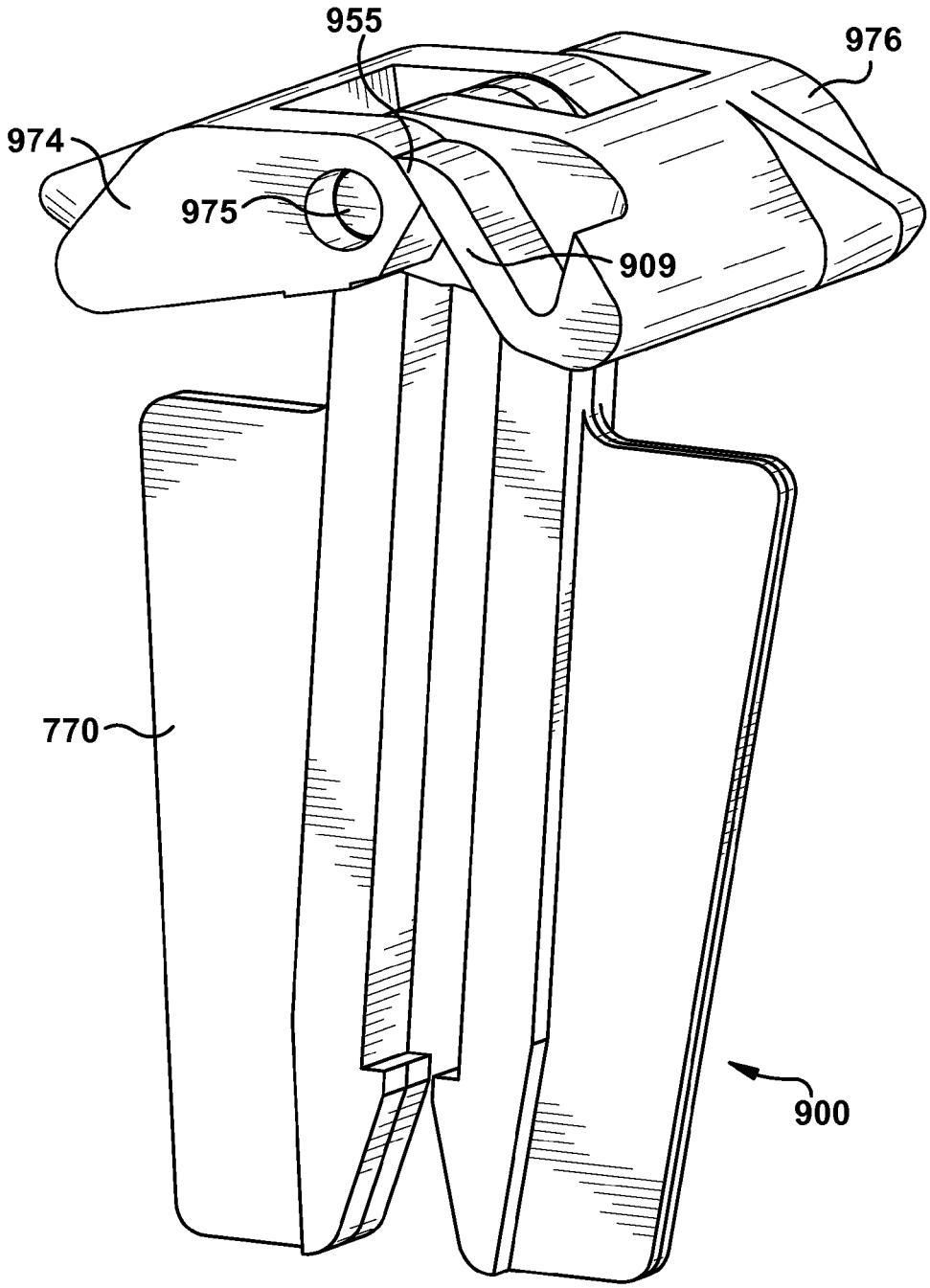
FIG. 10 shows a three-dimensional perspective view of an embodiment of a motion transfer system in accordance with an aspect of the invention.

Turning to FIG. 9, a perspective view of a motion transfer system 900 is shown in a closed position according to embodiments. In this embodiment, a first transfer component 974 and a second transfer component 976 are connected to a pin 975. First transfer component 974 includes a first integral spring 909 positioned proximate second transfer component 976 such that motion of first transfer component 974 and second transfer component 976 about pin 975 may cause first integral spring 909 to contact and/or load against second transfer component 976. It is understood that either or both of first transfer component 974 and second transfer component 976 may include first integral spring 909. Further, it is understood that first transfer component 974 and second transfer component 976 may be identical or varied components, which may include any or all of the features described herein. In one embodiment, either or both of first transfer component 974 and second transfer component 976 may include a travel limit stop 922. Travel limit stop 922 is adapted to limit and/or partially define a range of motion for first transfer component 974, second transfer component 976, and/or motion transfer system 900. In one embodiment, travel limit stop 922 may be adjustable and/or tailorable. In one embodiment, travel limit stop 922 may limit or adjust an angular stop position for components of motion transfer system 900. In one embodiment, first integral spring 909 and/or travel limit stop 922 may be formed into transfer components 974 and 976. In another embodiment, first integral spring 909 and/or travel limit stop 922 may be attached to/installed upon transfer components 974 and 976. In one embodiment, when motion transfer system 900 is in a closed position, there is no spring load on first integral spring 909 and/or travel limit stop 922. Turning to FIG. 10, a perspective view of motion transfer system 900 is shown in an open position according to embodiments. In this embodiment, the open position causes first integral spring 909 on transfer component 974 and/or travel limit stop 922 to contact second transfer component 976 at an interference surface 955, the interference of this contact putting first integral spring 909 and/or travel limit stop 922 under load.

Figure 11:
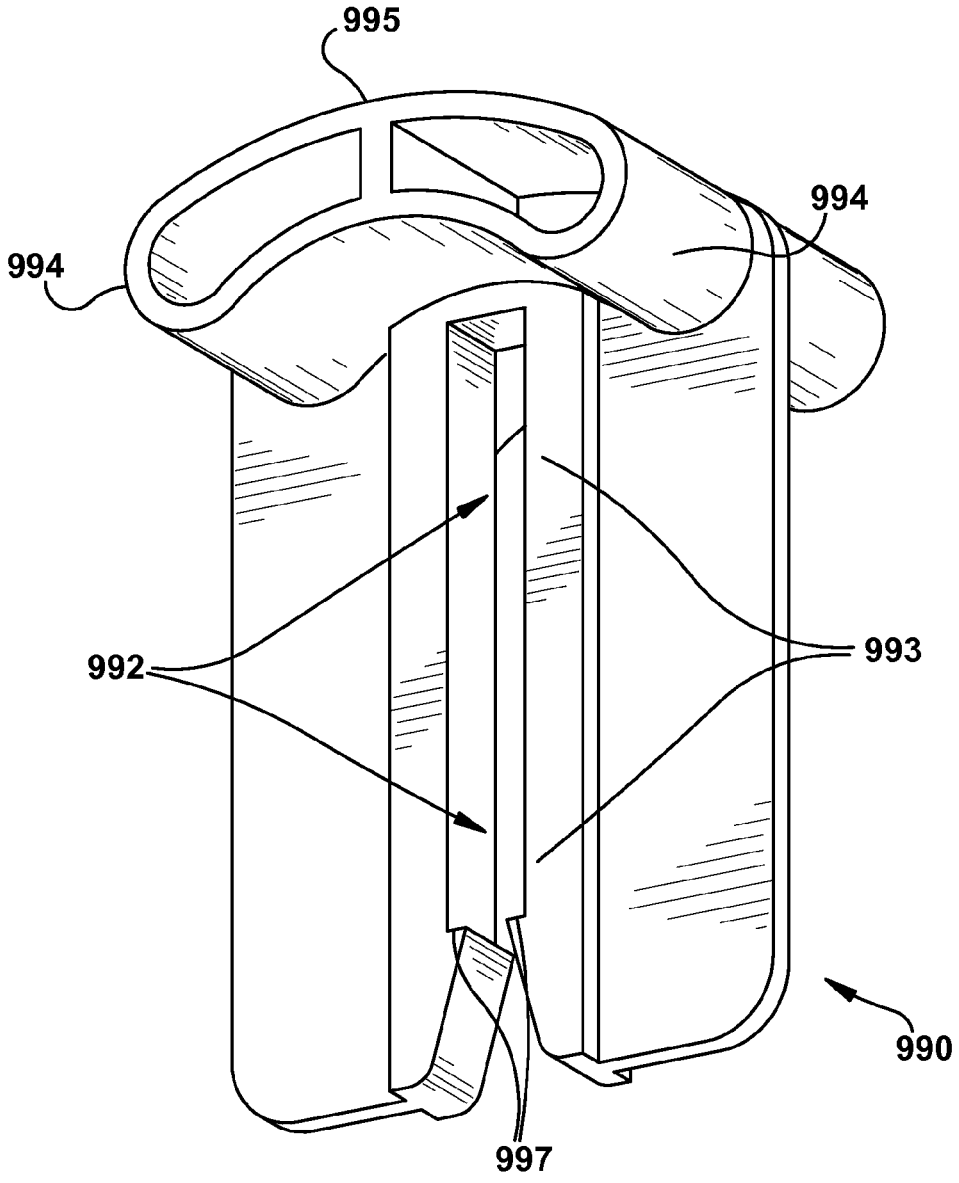
FIG. 11 shows a three-dimensional perspective view of an embodiment of a motion transfer system in accordance with an aspect of the invention.

Turning to FIG. 11, a perspective view of an embodiment of a motion transfer system 990 is shown according to embodiments. In this embodiment, motion transfer system 990 is a unified body which includes an actuator contact surface 995, a set of camming surfaces 994, and a sliding cam 993 defining an aperture 992 adapted to slidingly receive a terminal blade 102 (shown in FIG. 12) of a utility meter 107 (shown in FIG. 12). Actuator contact surface 995 is adapted to connect to actuator 250 (shown in FIG. 2), either directly or via transfer bar 254, to enable adjustment (e.g., movement from a first position to a second position) of motion transfer system 990. In one embodiment, set of camming surfaces 994 may be adapted to contact set of conductors 112 such that movement of motion transfer system 990 between the first and the second position causes set of conductors 112 to engage and/or disengage from terminal blade 102. In one embodiment, set of camming surfaces 994 maintain contact with set of conductors 112. In one embodiment, set of camming surfaces 994 may be rounded. In another embodiment, set of camming surfaces 994 may maintain a tangential interference fit between motion transfer system 990 and set of conductors 112. In this embodiment, motion transfer system 990 remains engaged with set of conductors 112 as an integral part of a conductor assembly in utility meter 107. In one embodiment, motion transfer system 990 includes a set of terminal blade notches 997 adapted to secure motion transfer system 990 about terminal blade 102. In one embodiment, motion transfer system 990 is comprised of a non-conductive material. In one embodiment, motion transfer system 990 is formed from a single piece of stock.

Figure 12:
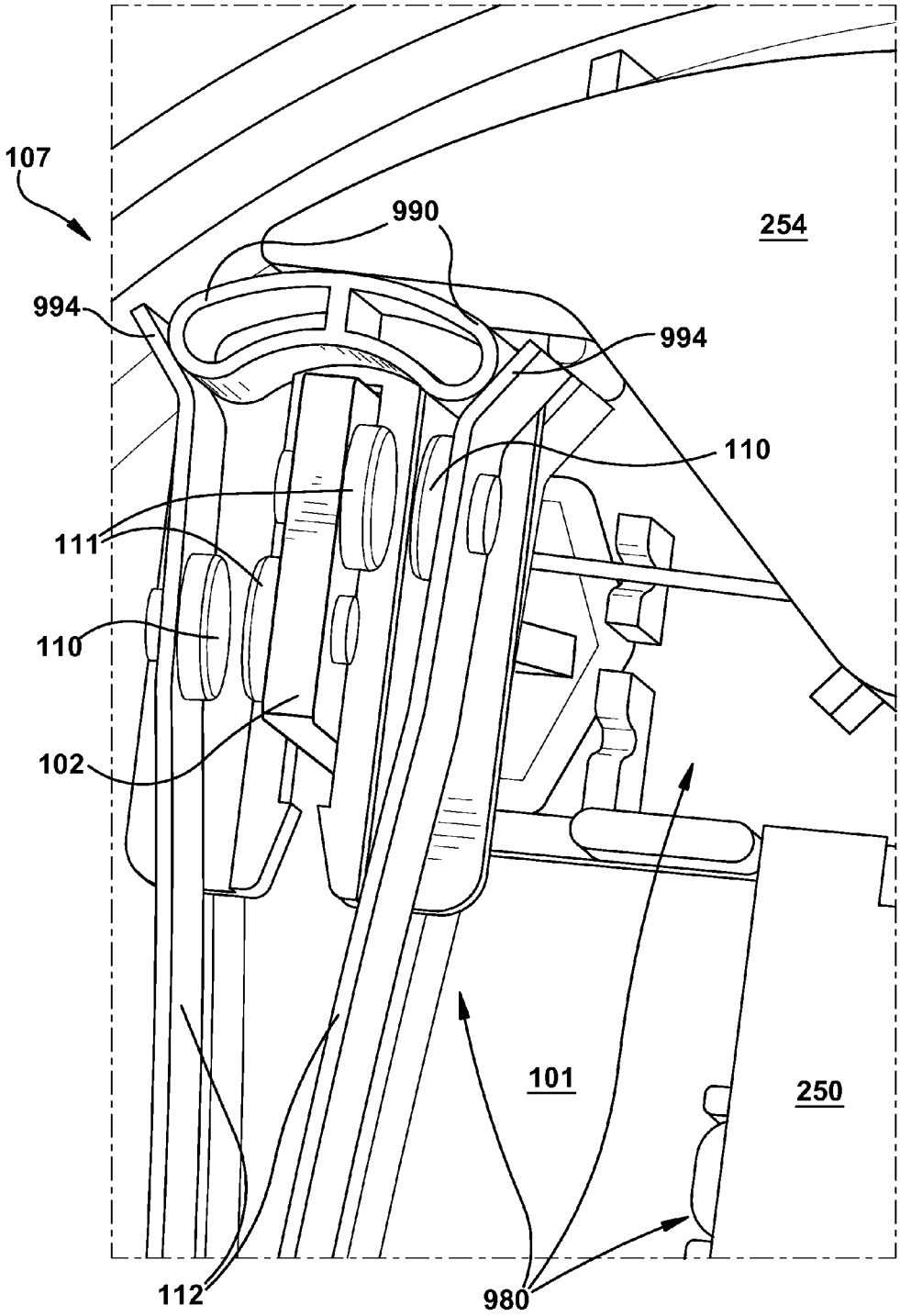
FIG. 12 shows a partial cut-away schematic view of portions of a utility meter according to an embodiment of the invention.

Turning to FIG. 12, a partial cross-sectional view of a utility meter 107 is shown according to embodiments of the invention. Utility meter 107 may include a meter base assembly 101 with a terminal blade 102 configured in substantial proximity to a set of conductors 112. Set of conductors 112 are connected to a metering circuit 140 (shown in FIG. 1) and are configured to convey a service from terminal blade 102 to metering circuit 140 via a set of conductor contacts 110 and a complementary set of terminal blade contacts 111. Adjustment of a position of set of conductors 112 controls a connection between set of conductor contacts 110 and set of terminal blade contacts 111, thereby regulating the state (e.g., connected, disconnected, etc.) of utility meter 107. A switch system 980 is included in utility meter 107 to connect and disconnect service at utility meter 107. Switch system 980 includes an actuator 250 operably connected to a distribution bar 254 which transfers a force from actuator 250 to a motion transfer system 990 which is secured substantially about a portion of terminal blade 102 and between set of conductors 112. Motion transfer system 990 is configured to manipulate set of conductors 112 thereby adjusting a position of set of conductor contacts 110, allowing the contacts to physically touch (e.g., connect) or separate from set of terminal blade contacts 111 (e.g., disconnect), and thereby regulating the state of utility meter 100.

In one embodiment, portions of motion transfer system 990 may include nonconductive materials. In one embodiment, motion transfer system 990 may be configured to continually contact set of conductors 112, forming a tangential interference fit. In one embodiment, motion transfer system 990 controls and maintains a position of set of conductors 112 relative to terminal blade 102. Motion transfer system 990 maintains a lateral relationship between each of the conductors 112 in the set of conductors 112 relative to a lateral location of terminal blade 102 (e.g., set of conductors 112 always move in unison with respect to terminal blade 102 during left to right movements).

In an embodiment of the invention, camming surfaces 994 are connected to conductors 112 such that a vertical motion of motion transfer system 990 on terminal blade 102 causes camming surfaces 994 to exert a force on conductors 112. In one embodiment, this force exerted by camming surfaces 994 generates a horizontal motion which separates conductors 112.

Figure 13:
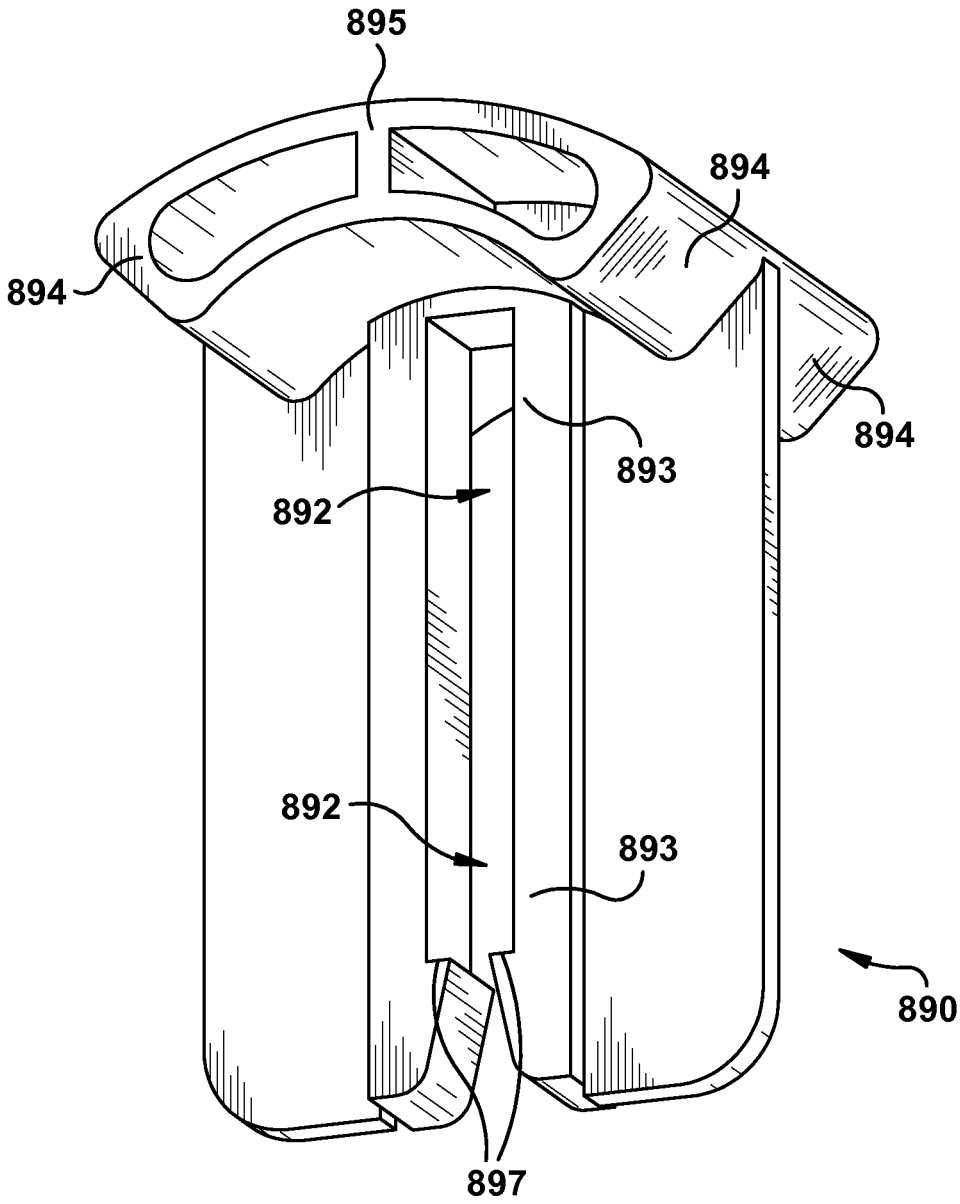
FIG. 13 shows a three-dimensional perspective view of an embodiment of a motion transfer system in accordance with an aspect of the invention.

Turning to FIG. 13, a perspective view of an embodiment of a motion transfer system 890 is shown according to embodiments. In this embodiment, motion transfer system 890 is a unified body which includes an actuator contact surface 895, a set of angled surfaces 894, and a sliding cam 893 defining an aperture 892 adapted to slidingly receive a terminal blade 102 (shown in FIG. 14) of a utility meter 107 (shown in FIG. 14). Actuator contact surface 895 is adapted to contact actuator 250 (shown in FIG. 2), either directly or via transfer bar 254, to enable adjustment (e.g., movement from a first position to a second position) of motion transfer system 890. In one embodiment, set of angled surfaces 894 may be adapted to contact set of conductors 112 such that movement of motion transfer system 890 between the first and the second position causes set of conductors 112 to engage and/or disengage from terminal blade 102. In one embodiment, set of angled surfaces 894 maintain contact with set of conductors 112. In one embodiment, set of angled surfaces 894 may include non-conductive materials. In this embodiment, motion transfer system 890 remains engaged with set of conductors 112 as an integral part of a conductor assembly in utility meter 107. In one embodiment, motion transfer system 890 includes a set of terminal blade notches 897 adapted to secure motion transfer system 890 about terminal blade 102. In one embodiment, motion transfer system 890 is comprised of a non-conductive material. In one embodiment, motion transfer system 890 is formed from a single piece of stock.

Figure 14:
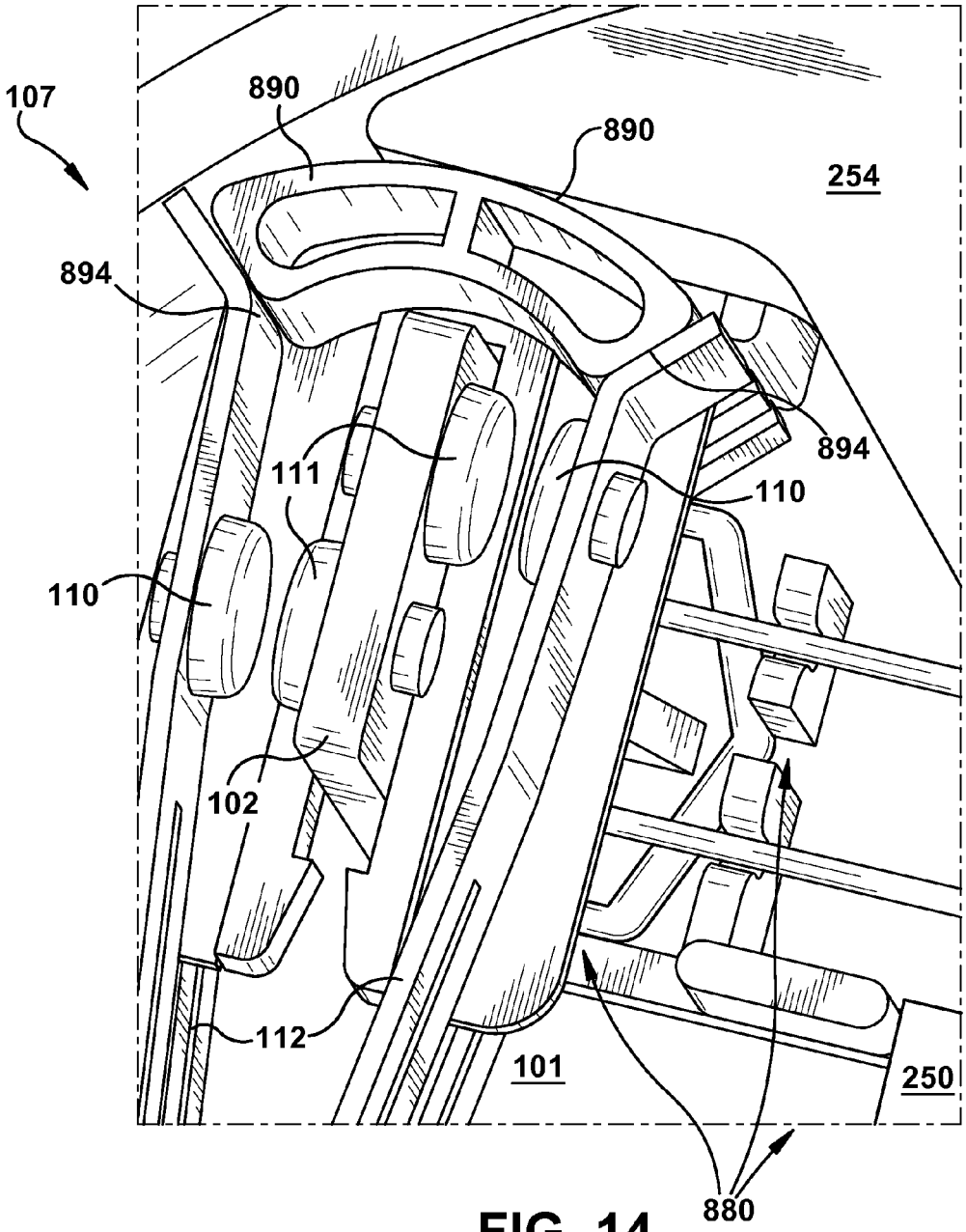
FIG. 14 shows a partial cut-away schematic view of portions of a utility meter according to an embodiment of the invention.

Turning to FIG. 14, a partial cross-sectional view of a utility meter 107 is shown according to embodiments of the invention. Utility meter 107 may include a meter base assembly 101 with a terminal blade 102 configured in substantial proximity to a set of conductors 112. Set of conductors 112 are connected to a metering circuit 140 (shown in FIG. 1) and are configured to convey a service from terminal blade 102 to metering circuit 140 via a set of conductor contacts 110 and a complementary set of terminal blade contacts 111. Adjustment of a position of set of conductors 112 controls a connection between conductor contacts 110 and terminal blade contacts 111, thereby regulating the state (e.g., connected, disconnected, etc.) of utility meter 107. A switch system 880 is included in utility meter 107 to connect and disconnect service at utility meter 107. Switch system 880 includes an actuator 250 operably connected to a distribution bar 254 which transfers a force from actuator 250 to a motion transfer system 890 which is secured substantially about a portion of terminal blade 102 and between set of conductors 112. Motion transfer system 890 is configured to manipulate set of conductors 112 thereby adjusting a position of set of conductor contacts 110, allowing the contacts to physically touch (e.g., connect) or separate from terminal blade contacts 111 (e.g., disconnect), and thereby regulating the state of utility meter 100.

In one embodiment, motion transfer system 890 may be configured to continually contact set of conductors 112, forming an angled interference fit. In one embodiment, motion transfer system 890 controls and maintains a position of set of conductors 112 relative to terminal blade 102. Motion transfer system 890 maintains a lateral relationship between each of the conductors 112 in the set of conductors 112 relative to a lateral location of terminal blade 102 (e.g., set of conductors 112 always move in unison with respect to terminal blade 102 during left to right movements). In an embodiment of the invention, angled surfaces 894 are connected to conductors 112 such that a vertical motion of motion transfer system 890 on terminal blade 102 causes angled surfaces 894 to exert a force on conductors 112. In one embodiment, this force exerted by angled surfaces 894 generates a horizontal motion, which slidingly adjusts a position of set of conductors 112.

The switching and motion transfer systems of the present disclosure are not limited to any one particular meter, utility meter system or other system, and may be used with other metering systems and/or systems. Additionally, the switching and motion transfer systems of the present invention may be used with other systems not described herein that may benefit from the versatility of the switch system described herein.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A switch system for a utility meter, the switch system comprising:

an actuator connected to a sliding cam for moving the sliding cam between a first position and a second position, the sliding cam slidingly receiving a terminal blade of the utility meter and including a pair of camming surfaces for disengaging a set of conductors from the terminal blade in response to being moved from the first position to the second position by the actuator, wherein the sliding cam is configured to move in a vertical direction about the terminal blade.

2. The switch system of claim 1 further comprising a set of transfer components physically connected to the sliding cam via a pin, wherein the set of transfer components are configured to pivot about the pin and adjust a position of the set of conductors.

3. The switch system of claim 2 further comprising a distribution bar operatively connected to the actuator and the sliding cam, the distribution bar adapted to transfer a force from the actuator to the sliding cam.

4. The switch system of claim 1, wherein the set of conductors are spring conductors.

5. The switch system of claim 1, wherein the actuator includes a service switch with an off position and an on position.

6. The switch system of claim 5, wherein the service switch includes a receiver for receiving instructions for changing a position of the service switch.

7. The switch system of claim 1, wherein the sliding cam is configured to substantially enclose a portion of the terminal blade.

8. The switch system of claim 3, wherein at least one of the sliding cam, the set of transfer components, the distribution bar, and the pin are nonconductive.

9. A motion transfer system for a utility meter switch, the motion transfer system comprising:

a sliding cam configured to complement a terminal blade of a utility meter, wherein the sliding cam is configured to substantially enclose a portion of the terminal blade; and a set of transfer components physically connected to the sliding cam via a pin, wherein the set of transfer components are configured to pivot about the pin and adjust a position of a set of conductors within the utility meter in response to the sliding cam moving about the terminal blade.

10. The motion transfer system of claim 9, wherein the set of conductors are spring conductors.

11. The motion transfer system of claim 9, wherein the sliding cam is configured to move in a vertical direction about the terminal blade.

12. The motion transfer system of claim 9, wherein at least one of the sliding cam, the set of transfer components and the pin are nonconductive.

13. A meter base assembly, comprising;

a metering circuit for metering a utility service;

a set of conductors operatively connected to the metering circuit;

a set of terminal blades disposed within a substantial proximity of the set of conductors, the set of terminal blades configured to operatively connect to the set of conductors via a set of contacts; and a switch system operatively connected to the set of conductors and configured to manipulate the connection between the set of terminal blades and the set of conductors, the switch system including:

an actuator;

a distribution bar operatively connected to the actuator; and at least one motion transfer system operatively connected to the distribution bar and configured to manipulate the set of conductors, the at least one motion transfer system including:

a sliding cam configured to complement the set of terminal blades, wherein the sliding cam is configured to move in a vertical direction about the set of terminal blades; and a set of transfer components physically connected to the sliding cam via a pin, wherein the set of transfer components are configured to pivot about the pin and adjust a position of the set of conductors.

14. The meter base assembly of claim 13, wherein the set of conductors are configured to clamp to the set of terminal blades and convey an electrical current via the contacts, an electromotive force of the electrical current assisting in clamping the set of conductors to the set of terminal blades.

15. The meter base assembly of claim 13, wherein the actuator includes a service switch with an off position, and an on position.

16. The meter base assembly of claim 13, wherein the transfer components are centrally pivoted.

17. The meter base assembly of claim 13, wherein the set of conductors are spring conductors.

18. The meter base assembly of claim 13, wherein the sliding cam is configured to substantially enclose a portion of the terminal blade.

19. The meter base assembly of claim 13, wherein at least one of the sliding cam, the set of transfer components, the distribution bar, and the pin are nonconductive.

* * * * *